US009060667B2

(12) United States Patent
Jeong et al.

(10) Patent No.: US 9,060,667 B2
(45) Date of Patent: Jun. 23, 2015

(54) SUMP OF DISHWASHER

(75) Inventors: Hae Deog Jeong, Changwon-si (KR); Byung Hwan Ahn, Gimhac-si (KR); Hung Myong Cho, Gimhae-si (KR); Sang Woo Woo, Gimhae-si (KR); Jong Chul Bang, Gimhae-si (KR)

(73) Assignee: LG ELECTRONICS INC., Seoul (KR)

( * ) Notice: Subject to any disclaimer, the term of this patent is extended or adjusted under 35 U.S.C. 154(b) by 1638 days.

(21) Appl. No.: 10/584,667

(22) PCT Filed: Nov. 26, 2005

(86) PCT No.: PCT/KR2005/004010

§ 371 (c)(1),
(2), (4) Date: Sep. 23, 2009

(87) PCT Pub. No.: WO2006/062305

PCT Pub. Date: Jun. 15, 2006

(65) Prior Publication Data

US 2010/0012160 A1 Jan. 21, 2010

(30) Foreign Application Priority Data

Dec. 7, 2004 (KR) ..... 10-2004-0102562

(51) Int. Cl.
*A47L 15/42* (2006.01)

(52) U.S. Cl.
CPC ..... *A47L 15/4225* (2013.01); *A47L 15/4204* (2013.01); *A47L 15/4208* (2013.01)

(58) Field of Classification Search
USPC ..... 134/56 D, 57 D, 58 D, 104.1 D, 110, 111
See application file for complete search history.

(56) References Cited

U.S. PATENT DOCUMENTS

| | | | | |
|---|---|---|---|---|
| 4,150,680 | A | 4/1979 | Johnson et al. | |
| 4,416,300 | A * | 11/1983 | Jordan | 134/108 |
| 4,612,947 | A | 9/1986 | Duncan | |
| 5,450,868 | A | 9/1995 | Young, Jr. | |
| 5,620,014 | A * | 4/1997 | Milocco et al. | 134/108 |

(Continued)

FOREIGN PATENT DOCUMENTS

EP 1935308 A2 6/2008

(Continued)

OTHER PUBLICATIONS

Machine Translation of Ha, KR 10-0457589, Nov. 2004.*
Machine Translation of Errasti, FR 2596429 A, Oct. 1987.*
International Search Report dated Feb. 22, 2006.

*Primary Examiner* — David Cormier
(74) *Attorney, Agent, or Firm* — McKenna Long & Aldridge LLP

(57) ABSTRACT

There is provided a sump of a dishwasher having a plurality of nozzles for spraying washing water. The sump includes a sump case for storing the washing water, a sump cover covering the sump case, a self-cleaning filter installed on the sump cover to filter foreign objects contained in the washing water stored in the sump case, a washing pump for pumping out the washing water stored in the sump case, a pump lower receiving the washing pump and providing a soil chamber in which the foreign objects contained in the washing water are accumulated, a washing motor installed on the sump case to drive the washing pump, a drain pump installed on the sump case to drain the washing water, and a drain motor for driving the drain pump.

13 Claims, 5 Drawing Sheets

(56) References Cited

U.S. PATENT DOCUMENTS

| | | | | |
|---|---|---|---|---|
| 5,711,326 | A | 1/1998 | Thies et al. | |
| 6,182,674 | B1 | 2/2001 | Jozwiak et al. | |
| 2004/0003833 | A1 * | 1/2004 | Elick et al. | 134/111 |
| 2004/0173245 | A1 | 9/2004 | Elick et al. | |

FOREIGN PATENT DOCUMENTS

| | | | | |
|---|---|---|---|---|
| FR | 2596429 | A | * | 10/1987 |
| JP | 03-143420 | | | 6/1991 |
| KR | 10-0457589 | | * | 11/2004 |
| WO | 2006046053 | A1 | | 5/2006 |

* cited by examiner

SUMP OF DISHWASHER

This application claims priority to International application No. PCT/KR2005/004010 filed on Nov. 26, 2005 and Korean Application No. 10-2004-0102562 filed on Dec. 7, 2004, all of which are incorporated by reference, as if fully set forth herein.

TECHNICAL FIELD

The present invention relates to a dishwasher, and more particularly, to a sump OF a dishwasher.

BACKGROUND ART

A dishwasher is a home appliance that uses a washing pump to pump out washing water. The washing water pumped out from the washing pump is sprayed from spray nozzles to wash dishes loaded in upper and lower racks. The dishes washed are dried. The dishwasher includes a tub defining an outer appearance of the dishwasher, dish racks disposed inside the tub for placing dishes thereupon in a predetermined arrangement, spray nozzles for spraying washing water onto the surfaces of the dishes, and a sump installed at the bottom of the tub for storing washing water.

A heater is installed on a surface inside the sump for heating washing water flowing into the sump, and a turbidity sensor is installed at a location where washing water flows inside the sump for sensing the impurity level of the washing water during a wash cycle. When the pollution level of washing water exceeds a preset level, the washing water is drained, and fresh washing water is drawn in.

Also, the dishwasher pressurizes the washing water spray from the spray nozzles to remove food reside from dishes, and the food residue removed from the surfaces of the dishes falls to collect on the floor of the tub. A filter for filtering the foreign objects is installed at the top of the sump, to ensure that a large resistance to the flow of washing water is not imposed by large foreign objects entering and sticking inside the sump. To prevent the above, a disposer for pureeing large foreign objects is installed inside the sump. Thus, the blockage of washing water passages by foreign objects during the flowing of washing water stored in the sump to the spray nozzles can be prevented.

However, sumps of dishwashers according to the related art have limited space in which to store washing water, and can only store small amounts of washing water.

In addition, in some dishwashers, since the heater for heating washing water entering the sump is installed outside the sump, the overall size of the dishwasher increases.

Furthermore, because dishwashers according to the related art have marginally effective filters, food residue and other foreign objects that occur during a wash cycle can enter the spray nozzles and clog the spray holes thereof.

DISCLOSURE

Technical Problem

An object of the present invention is to provide an improved and optimized sump of a dishwasher with an increased storage capacity for washing water without an increase in the overall size of the sump.

Another object of the present invention is to provide a dishwasher sump that allows effective flow of washing water inside the sump and minimizes the occurrence of foreign objects included in washing water from entering the spray nozzles.

Technical Solution

In an aspect of the present invention, there is provided a sump of a dishwasher having a plurality of nozzles for spraying washing water, the sump comprising: a sump case for storing the washing water; a sump cover covering the sump case; a self-cleaning filter installed on the sump cover to filter foreign objects contained in the washing water stored in the sump case; a washing pump for pumping out the washing water stored in the sump case; a pump lower receiving the washing pump and providing a soil chamber in which the foreign objects contained in the washing water are accumulated; a washing motor installed on the sump case to drive the washing pump; a drain pump installed on the sump case to drain the washing water; and a drain motor for driving the drain pump.

In another aspect of the present invention, there is provided a sump of a dishwasher having a plurality of nozzles for spraying washing water, the sump comprising: a sump case; a self-cleaning filter for filtering foreign objects contained in the washing water stored in the sump case; a sump cover coupled to the self-cleaning filter and provided with a return hole through which the washing water flowing backward through the self-cleaning filter is returned to the sump case; a pump unit for pumping out the washing water stored in the sump case; a guide member for guiding the flow of the washing water pumped by the pump unit; and a drain unit for draining the washing water.

In a still another aspect of the present invention, there is provided a sump of a dishwasher having a plurality of nozzles for spraying washing water, the sump comprising: a sump case; a sump cover covering the sump case; a fluid passage guide installed on the sump cover to guide the flow of the washing pump; a pump lower receiving a pumping unit and providing a soil chamber in which the foreign objects contained in the washing water are accumulated; a dispensing unit for dispensing washing water pumped out from the pumping unit to the nozzles; a turbidity sensor for detecting a pollution level of the washing water; and a washing motor for driving the pumping unit.

Advantageous Effects

According to the sump of the present invention, an overall size of the tub mounted in the dishwasher can be reduced.

In addition, by improving the fluid passage structure extending toward the spray nozzles in the sump, the sump of the dishwasher allows effective flow of washing water inside the sump and minimizes the occurrence of foreign objects included in washing water from entering the spray nozzles.

Furthermore, since the heater is installed inside the sump, the electric power consumption for heating the washing water can be reduced.

It is to be understood that both the foregoing general description and the following detailed description of the present invention are exemplary and explanatory and are intended to provide further explanation of the invention as claimed.

BEST MODEL

Reference will now be made in detail to the preferred embodiments of the present invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 1:
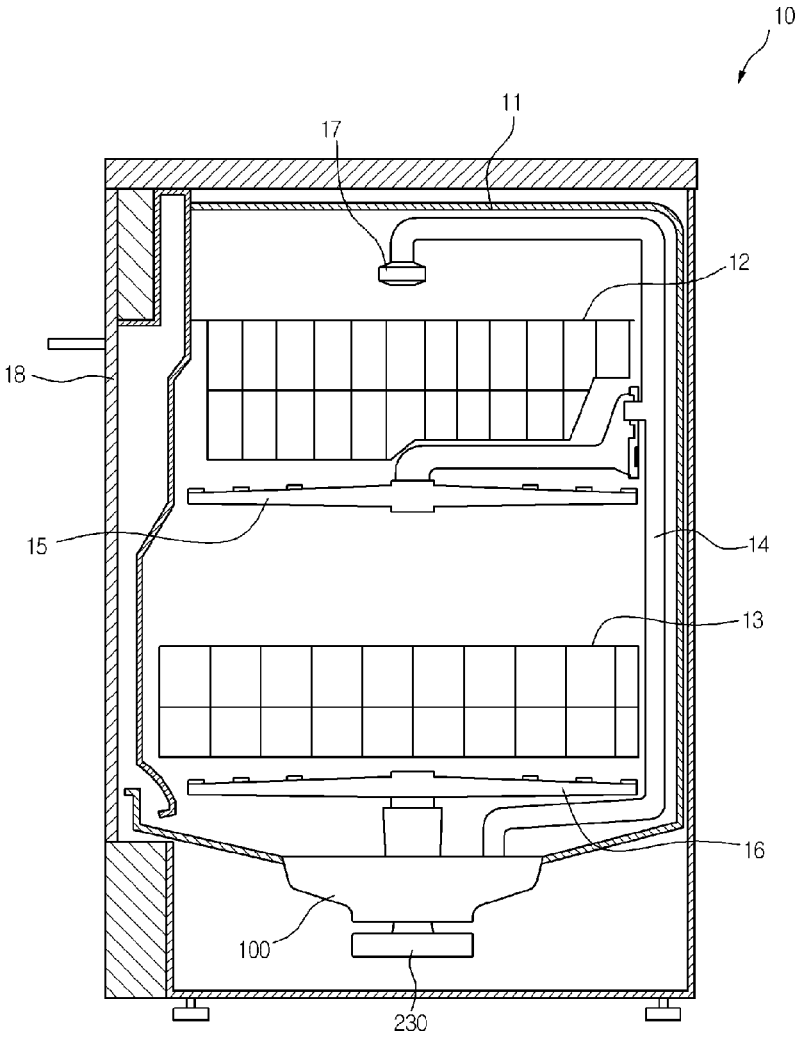
FIG. 1 is a sectional view of a dishwasher having a sump assembly according to an embodiment of the present invention.

FIG. 1 is a sectional view of a dishwasher having a sump assembly according to an embodiment of the present invention.

Referring to FIG. 1, a dishwasher 10 includes a tub defining a washing chamber, a door 18 provided in front of the tub 11 to open and close the washing chamber, and a sump assembly 100 mounted on a bottom-center of the tub 11 and reserving washing water therein.

The dishwasher 10 further includes a washing motor 230 mounted on a bottom of the sump assembly 100 and disposed in the sump assembly 100 to drive a washing pump (not shown), a water guide 14 defining a path along which washing water pumped out by the washing pump flows, a lower nozzle 16 coupled to a top of the sump assembly 100 to the washing water spray upward and/or downward in the washing chamber, an upper nozzle 15 extending from a portion of the water guide 14 toward a center of the tub 11, and a top nozzle 17 extending from a top of the water guide 14 and located near a ceiling of the tub 11 to spray the washing water downward.

The dishwasher 10 further includes an upper rack 12 placed right above the upper nozzle 15 and a lower rack 13 disposed right above the lower nozzle 16. That is, the dishes received on the upper rack 12 are washed by the washing water sprayed from the upper and top nozzles 15 and 17. The dishes received on the lower rack 13 are washed by the washing water sprayed from the lower nozzle 16.

The operation of the dishwasher 10 will be now described.

The door 18 is first opened and the upper rack 12 and/or lower rack 13 are withdrawn out of the dishwasher 10. The dishes are arranged on the racks 12 and 13. Then, the racks 12 and 13 are returned to their initial locations and the door 18 is closed. The operation button is pushed to wash the dishes received on the racks 12 and 13.

Meanwhile, when the operation button is pushed, a water supply valve is opened so that the washing water is supplied into the sump assembly 100. After a predetermined amount of the washing water is supplied into the sump assembly 100, the washing motor 230 operates. At this point, an impeller (refer to the reference number 2 of FIG. 2) connected to a motor shaft of the washing motor 230 and disposed in the washing pump rotates to pump the washing water to the lower nozzle 16 and the water guide 14.

The washing water pumped out to the water guide 14 is sprayed into the washing chamber via the top and upper nozzles 17 and 15. The washing water sprayed downward from the top nozzle 17 and the washing water sprayed upward from the upper nozzle 15 wash the dishes loaded on the upper rack 12. The washing water sprayed upward from the lower nozzle 16 washes the dishes loaded on the lower rack 13. By forming spraying holes on a bottom of the upper nozzle 15, the upper nozzle 15 may spray the washing water upward and downward to simultaneously wash both surfaces of the dishes.

The foreign objects generated during the washing process are filtered by a filter (not shown) provided in the sump assembly 100 and ground to small particles by a disposer (not shown) mounted in the sump assembly 100. When the washing process is finished, the used washing water is drained together with the foreign objects out of the dishwasher 10 through a drain pump (not shown).

When the used washing water is drained, clean rinsing water is supplied to the sump assembly 100 through a washing water inlet and sprayed through the nozzles 15, 16 and 17 to perform a rinsing process. When the rinsing process is finished, a drying process is performed to finalize the whole washing process.

Figure 2:
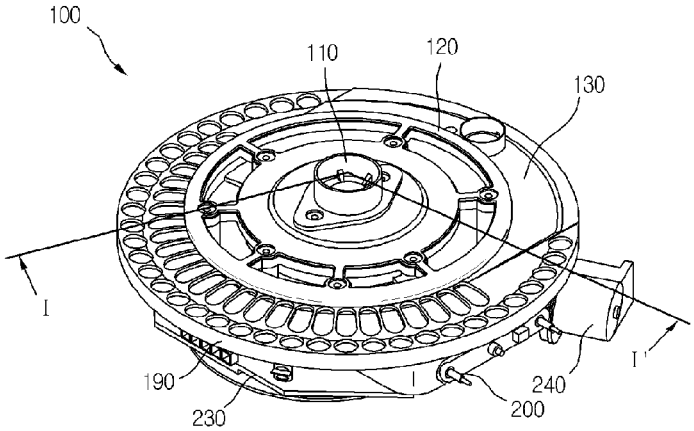
FIG. 2 is a perspective view of a sump assembly depicted in FIG. 1.
Figure 3:
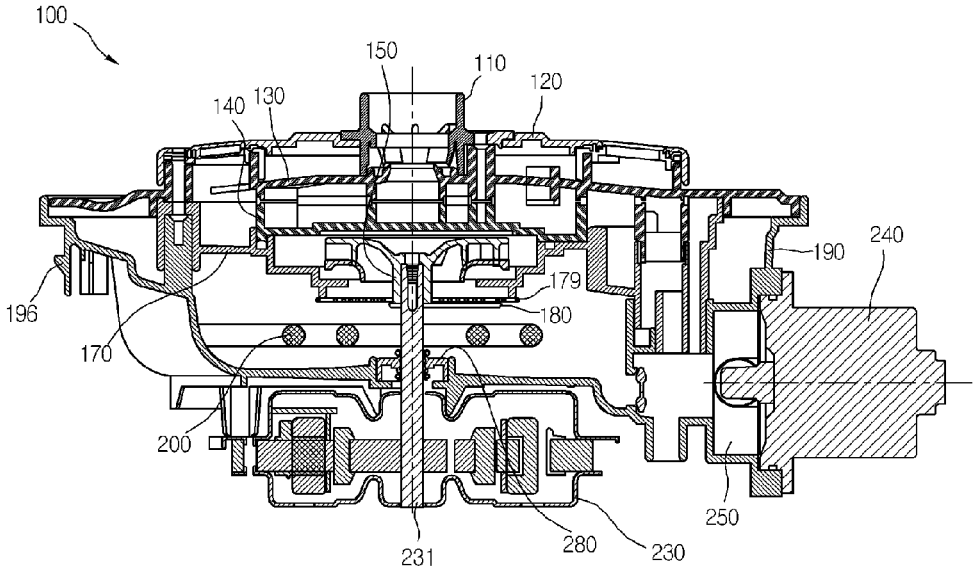
FIG. 3 is a vertical sectional view taken along lines I-I of FIG. 2.
Figure 4:
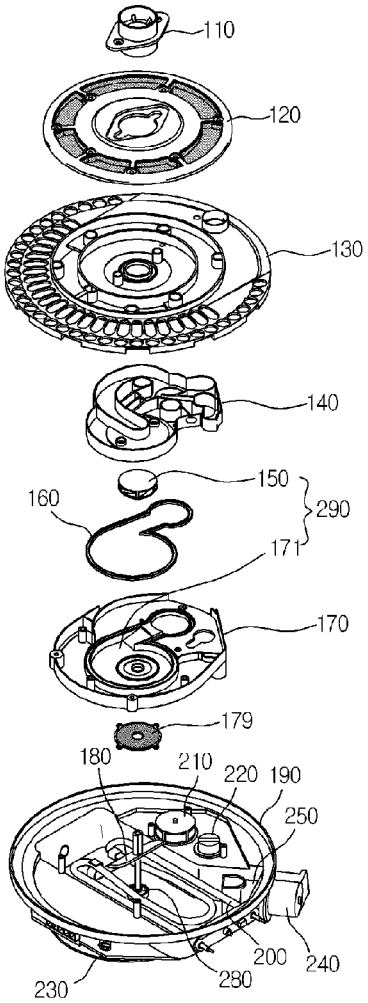
FIG. 4 is an exploded perspective view of a sump assembly depicted in FIG. 1.

FIG. 2 is a perspective view of a sump assembly depicted in FIG. 1, FIG. 3 is a vertical sectional view taken along lines I-I of FIG. 2, and FIG. 4 is an exploded perspective view of the sump assembly depicted in FIG. 1. Referring to FIGS. 2 through 4, the sump assembly 100 includes a sump case 190 for reserving the washing water, a sump cover 130 for covering an opening of the sump case 190, a self-cleaning filter assembly 120 disposed on a top portion of the sump cover 130 and elevated by a predetermined height, a lower nozzle holder 110 disposed on the central portion of the self-cleaning filter assembly 120 and connected to the lower nozzle 16, a washing motor 230 mounted on a lower portion of the sump case 190 to generate rotational force, and a drain pump 250 and a drain motor 240 that are mounted on a side portion of the sump case 190 to drain the washing water to an external side. In addition, the sump assembly 100 further includes a heater 200 mounted on an inner bottom of the sump case 190 to heat the washing water, a disposer 180 rotating together with a motor shaft 231 to grind food residue, a pump lower 170 forming a soil chamber in which the food residue is accumulated, a fluid passage guide 140 disposed between the sump cover 130 and the pump lower 170, a washing pump 290 disposed between the pump lower 170 and the fluid passage guide 140 to pump out the washing water, and a screen filter 179 disposed between the pump lower 170 and the disposer 180 to prevent the food waste ground by the disposer 180 from being introduced into the washing pump 290.

The screen filter 179 is provided with a plurality of pores to filter the food residue and attached on a bottom of the pump lower 170. The washing pump 290 includes a pump case 171 disposed on a central portion of the pump lower 170 and an impeller 150 disposed in the pump case 171. The impeller 150 rotates together with the motor shaft 231 to suck the washing water reserved in the sump case 190 and discharge the sucked washing water to an external side. The fluid passage guide 140 is provided at a top surface with a passage for guiding the washing water pumped by the washing pump 290 to the upper nozzle or the lower nozzle. The passage will be described later with reference to the accompanying drawings.

The sump assembly 100 includes a vario valve 210 mounted on a side portion of the sump case 190, a turbidity sensor 220 mounted near the vario valve 210, and a pump sealer 160 fitted in a groove formed on a top surface of the pump lower 170. That is, the vario valve 210 functions to alternately flow to the upper and lower nozzles. The turbidity sensor 220 detects a pollution level of the washing water collected in the sump assembly 100 during the washing process. The pump sealer 160 prevents leakage of the washing water through edges of the washing pump 290 and the vario valve 210.

The operation of the above-described sump assembly 100 will be now described.

When the washing process starts, the washing water is supplied from the water supply unit to the sump case 190. At this point, the impeller 150 rotates by the operation of the washing motor 230 to direct the washing water into the pump case 171. The washing water directed to the pump case 171 flows to the vario valve 210. The washing water flowing to the vario valve 210 further flows to the water guide 14 or the upper nozzle holder 110 along the passage formed on the top surface of the fluid passage guide 110.

Meanwhile, a part of the washing water flowing from the washing pump 290 to the vario valve 210 flows to the turbidity sensor 220 so that the pollution level of the washing water can be detected. The washing water 220 passing through the turbidity sensor 220 flows to the drain pump 250. The washing water collected in the drain pump 250 is drained out of the dishwasher by the drain motor 240.

Figure 5:
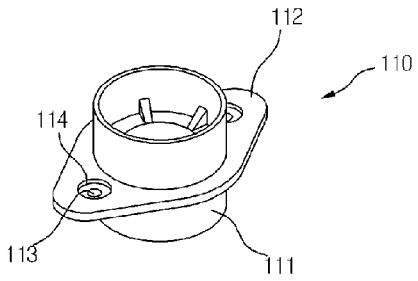
FIG. 5 is a perspective view of a lower nozzle holder depicted in FIG. 2.

FIG. 5 is a perspective view of the lower nozzle holder mounted on the top-central portion of the sump assembly.

Referring to FIG. 5, the lower nozzle holder 110 includes a cylindrical holder body 111 having a predetermined diameter and length, a seating plate 112 extending from an outer circumference of the holder body 111 and seating on the sump cover 120.

The seating plate 112 is provided with coupling holes 113 through which coupling members (not shown) penetrate by which the seating plate 112 is coupled to the sump cover 120. A depressed portion 114 having a predetermined depth and diameter is formed around each coupling hole 113. Therefore, when the coupling members are coupled, heads of the coupling members are snugly disposed in the depressed portions 114 without being protruded above a surface of the seating plate 112.

The holder body 111 extends from the seating plate 112 and contacts the sump cover 130. That is, the holder body 111 is directly connected to a drain hole (see the reference number 135*a* of FIG. 7) formed on a central portion of the sump cover 130 so that the washing water can be directly directed to the lower nozzle without being leaked.

Figure 6:
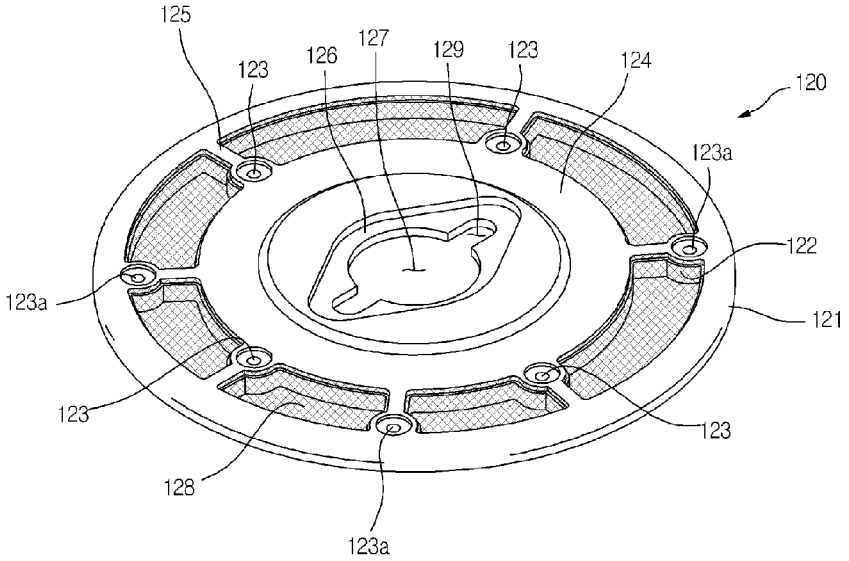
FIG. 6 is a perspective view of a self-cleaning filter assembly depicted in FIG. 2.

FIG. 6 is a perspective view of the self-cleaning filter assembly.

Referring to FIG. 6, the self-cleaning filter assembly 120 is disposed on the top of the sump cover 130. The self-cleaning filter assembly 120 filters foreign objects contained in the washing water when the washing water when the washing water passing through the turbidity sensor 220 flows backward from the floor of the tub.

The self-cleaning filter assembly 120 includes an upper frame 121, a mesh filter 128 adhered to a bottom of the upper frame 121, and a lower frame 122 disposed below the mesh filter 128 to strain the mesh filter 128. The upper and lower frames 121 and 122 are integrally formed with each other by a thermal bonding process.

The upper and lower frames 121 and 122 are formed in an identical shape. Each of the upper and lower frames 121 and 122 includes a leaked water collecting chamber cover 124 covering a top opening of the leaked water collecting chamber (see 132*b* of FIG. 7) that will be described later and a nozzle holder seating portion 126 depressed on a top surface of the leaked water collecting chamber cover 124. The seating plate 112 of the nozzle holder 110 seats on the nozzle holder seating portion 126.

The mesh filter 128 is formed in a circular strip shape and attached between the leaked water collection chamber cover 124 and the outer frame of the self-cleaning filter assembly 120. A nozzle holder insertion hole 127 through which the holder body 11 is inserted is formed on the nozzle holder seating portion 126. Side slots 129 in which the depressed portions 114 of the nozzle holder 110 are inserted are formed on the nozzle holder seating portion 126. The side slots 129 extend from the nozzle holder insertion hole 127. The leaked water collection chamber cover 124 is connected to the outer frame of the self-cleaning filter assembly 120 by frame bridges 125. That is, the frame bridges 125 extend from the outer circumference of the leaked water collection chamber cover 124 in a radial direction. By the frame bridges 125, the mesh filter 128 is divided into a plurality of sections each having a predetermined size. The frame bridges 125 functions to strain the mesh filter 128. The self-cleaning filter assembly 120 is provided with one or more sump cover coupling holes 123. By a coupling member penetrating the sump cover coupling hole 123, the self-cleaning filter assembly 120 is coupled to the sump cover 130. The self-cleaning filter assembly 120 is further provided with one or more addition sump case coupling holes 123*a* formed on the outer frame. By a coupling member penetrating the sump case coupling hole 123*a*, the self-cleaning filter assembly 120 is coupled to the sump case 190. Meanwhile, the outer frame of the self-cleaning filter assembly 120 extends downward by a predetermined height so that the self-cleaning filter 120 can be elevated from the top surface of the sump cover 130. As a result, the mesh filter 128 is to be disposed at a level elevated from the top surface of the sump cover 130. This is to prevent the mesh filter 128 from being immersed together with the sump cover 130 in the washing water reserved in the sump. This is to prevent the mesh filter 128 from being immersed together with the sump cover 130 in the washing water reserved in the sump. That is, this is to prevent the foreign objects clogging the mesh filter 128 from not being removed by the washing water that is sprayed from the lower nozzle 16 and does not reach the mesh filter 128.

That is, when the height of the mesh filter 128 is lower than a surface of the washing water reserved on the floor of the tub, the mesh filter is to be immersed in the washing water. In this case, since the washing water sprayed from the lower nozzle 16 cannot reach the mesh filter 128 by the washing water reserved on the floor of the tub, the foreign objects clogging the mesh filter 128 cannot be removed. When the foreign objects are not removed from the mesh filter 128, the washing water collected in the soil chamber 173 cannot flow backward to the floor of the tub 11 through the mesh filter 128. However, in the present invention, since the mesh filter 128 is disposed at a location elevated from a surface of the washing water reserved on the floor of the tub, the washing water sprayed from the lower nozzle 16 reaches the mesh filter 128, thereby effectively removing the foreign objects clogging the mesh filter 128.

Figure 7:
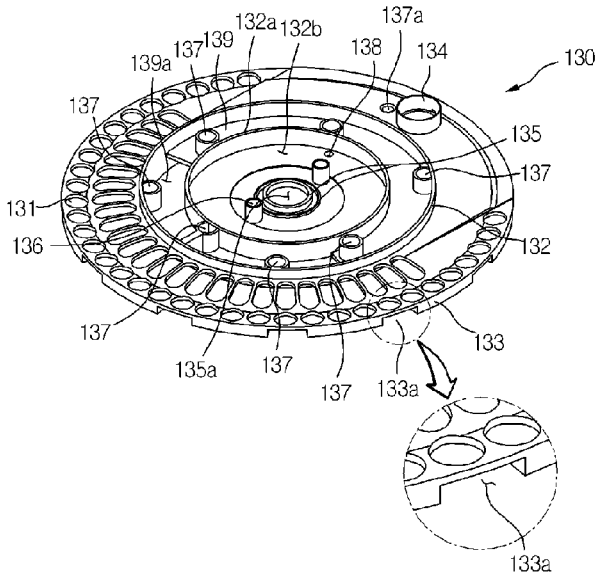
FIG. 7 is a perspective view of a sump cover depicted in FIG. 2.

FIG. 7 is a perspective view of the sump cover.

Referring to FIG. 7, as described above, the sump cover 130 covers the top opening of the sump case 190.

Describing in more detail, the sump cover 130 includes a plurality of water recovering holes 131 formed on an edge along at least one circumferential line, a filter supporting sleeve 132 circumferentially extending upward at an inner side with respect to the water returning holes 131, and a leaked water collecting sleeve 132*a* circumferentially extending upward at an inner side with respect to the filter supporting sleeve 132.

The washing water sprayed from the nozzles is recovered into the sump case 190 through the water recovering holes 131. The self-cleaning filter assembly 120 is disposed on a top of the filter supporting sleeve 132. A diameter of the leaked water collecting sleeve 132*a* is less than that of the filter supporting sleeve 132 to reserve the washing water that is leaked during the washing water flows toward the lower nozzle holder 110. That is, the leaked water collecting sleeve 132*a* defines a leaked water collecting chamber 132*b* for reserving the leaked water.

Two lower nozzle holder supporting ribs 135 are circumferentially formed on a central portion of the sump cover 130 and coupled to the holder body of the lower nozzle holder 110. A washing water discharge hole 135*a* is formed on an inner side of the nozzle holder supporting rib 135. The lower nozzle holder supporting ribs 135 are circumferentially spaced away from each other by a distance identical to a thickness of the holder body 111 and a lower end portion of the holder body 11 is inserted between the lower nozzle holder supporting ribs 135. The washing water discharged through the washing water discharge hole 135*a* flows to the lower nozzle. Two nozzle holder coupling bosses 136 to which the nozzle holder 110 is coupled are formed in the leaked water collecting chamber 132*b*. A water drain hole 138 through which the washing water collected in the leaked water collecting chamber 132*b* is drained is formed near an edge of the leaked water collecting chamber 132*b*.

A washing water backward hole 139*a* is formed on a part between the filter supporting sleeve 132 and the leaked water collecting sleeve 132*a* to allow the washing water flowing backward from the soil chamber 173 to flow backward into the tub through the self-cleaning filter 120. A foreign object collecting layer 139 is formed on a remaining part between the filter supporting sleeve 132 and the leaked water collecting sleeve 132*a*. A part of the washing water flowing backward through the washing water backward hole 136 139*a* is collected in the foreign object collecting layer 139. One or more self-cleaning filter coupling bosses 137 for coupling the self-cleaning filter assembly 120 are formed on an inner circumference of the filter supporting sleeve 132, an outer circumference of the leaked water collecting sleeve 132*a*, and the foreign object collecting layer 139.

A cylindrical water guide connecting member 134 on which the water guide 14 is mounted is formed on the edge of the sump cover 130. A coupling member insertion hole 137*a* in which a sump cover coupling boss 197*a* is inserted is formed beside the water guide connecting member on the edge of the sump cover 130.

Formed on the outer circumference of the sump cover 130 are a sump case seating rib 133 bent and extending downward by a predetermined length and foreign object drain grooves 133*a* formed by cutting portions of the sump case seating rib 133 by a predetermined width. The foreign object drain grooves 133*a* are formed to allow the food residue falling to a contacting portion of the floor of the tub 11 and an upper frame of the sump case 190 to be effectively directed into the sump case 190. A depth of the foreign object drain groove 133*a* may be less than or identical to a height of the sump case seating rib 133. Meanwhile, the outer circumference of the sump case seating rib 133 closely contacts the inner circumference of the sump case 190. As a result, the foreign objects falling to a boundary portion between the sump case 190 and the floor of the tub 1 may not be directed into the sump case 190. To prevent this, an outer diameter of the sump cover 130 is designed to be slightly less than an upper inner diameter of the sump case 190 so that the foreign objects can be effectively introduced into a gap between the sump cover 130 and the sump case 190.

Alternatively, the foreign object drain grooves 133*a* may be indented up to a bent portion where the sump case seating rib 133 starts and further indented slightly toward the center of the sump cover 130. That is, the foreign object drain groove 133*a* may be designed to have a +-shaped vertical section. By this shape, the foreign objects can be effectively introduced into the sump case 190 even when the outer circumference of the sump cover 130 closely contacts the inner circumference of the sump case 190. A plurality of foreign object drain grooves 133*a* may be formed throughout the outer circumference of the sump cover 130 or may be locally formed on the outer circumference of the sump cover 130.

By the above-described sump cover assembly 130, the washing water falling to the tub 11 is introduced into the sump case 190 through the water recovering hole 131 and the foreign objects drain grooves 133*a*. The washing water flowing backward from the soil chamber 173 is directed to the floor of the tub through the washing water backward hole 139*a* and is then introduced into the sump case 190 through the foreign object drain grooves 133*a*.

In addition, the washing water leaked through the gap between the nozzle holder supporting rib 135 and the holder body 111 of the nozzle holder 110 during the washing water flows to the lower nozzle 16 is collected in the leaked water collecting chamber 132*b*. The collected washing water is introduced into the sump case 190 through the water drain hole 138.

In addition, a portion of the washing water flowing backward through the washing water backward hole 139*a* is collected in the foreign object collecting layer 139. When the drain process starts, the washing water collected in the foreign object collecting layer 139 flows to the drain pump 250 through the washing water backward hole 139*a*.

Figure 8:
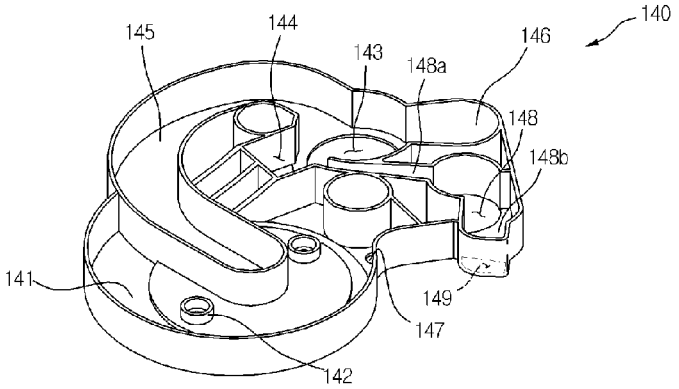
FIG. 8 is a perspective view of a fluid passage guide depicted in FIG. 3.

FIG. 8 is a perspective view of the fluid passage guide.

Referring to FIG. 8, the fluid guide 140 is mounted on the bottom of the sump cover 130.

The fluid passage guide 140 is provided with a fluid passage along which the washing water pumped by the washing pump 290 flows to the upper and lower nozzles 15 and 16.

Describing in more detail, the fluid passage guide 140 includes a washing pump cover 141 covering the pump case 171, a vario valve guide passage 144 formed in a tangential direction of the washing pump cover 141 to guide the washing water pumped by the washing pump 290 to the vario valve 210, a vario valve insertion hole 143 formed on an end portion of the vario valve guide passage 144, a turbidity sensor insertion hole formed at a location spaced apart from the vario valve insertion hole 143 by a predetermined distance.

The fluid passage guide 140 further includes a lower nozzle passage 145 having a first end connected to the vario valve insertion hole 143 and a second end reaching a central portion of the washing pump cover 141 and a water guide passage 146 extending from another point of the vario valve insertion hole 143 to guide the washing water to the water guide 14.

The fluid passage guide 140 further includes a turbidity sensor passage branched off from a point of the vario valve guide passage 144 and connected to the turbidity sensor insertion hole 148, a drain passage 148*b* extending from a point of the turbidity sensor insertion hole 148 to allow the washing water introduced through the turbidity sensor passage 148*a* to flow to the drain pump 250, and a drain pump connecting hole 149 formed on an end portion of the drain passage 149*b* to allow the washing water to fall to the drain pump 250.

A sump cover coupling boss 142 is formed on the washing pump cover 141 and the coupling member penetrating the nozzle holder coupling boss 136 of the sump cover 130 is inserted into the sump cover coupling boss 142. By the coupling member, the fluid passage guide 140 is adhered to the bottom of the sump cover 130. A drain hole 147 is formed at a located spaced apart from the sump cover coupling boss 142 by a predetermined distance. The washing water collected in the leaked water collecting chamber 132*b* of the sump cover 130 is drained to the sump case 190 through the drain hole 147. The fluid passage guide 140 is tightly adhered to the bottom of the sump cover 130 through a thermal bonding process.

By the above-described construction, the washing water pumped by the washing pump 290 flows to the vario valve 210 mounted in the vario valve insertion hole 143 through the vario valve guide passage 144 and is then selectively dispensed to one of the lower nozzle passage 145 and the water guide passage 146. Then, a portion of the washing water flows into the turbidity sensor 220 through the turbidity sensor passage 148*a* branched off from the vario valve guide passage 144. The turbidity sensor 220 detects the pollution level of the washing water. The washing water passing through the turbidity sensor 220 flows the drain pump 250 through the drain passage 148 and the drain pump connecting hole 149. In addition, the leaked washing water falling through the drain hole 138 formed on the sump cover 130 falls to the sump case 190 through the drain hole 147 of the fluid passage guide 140.

Figure 9:
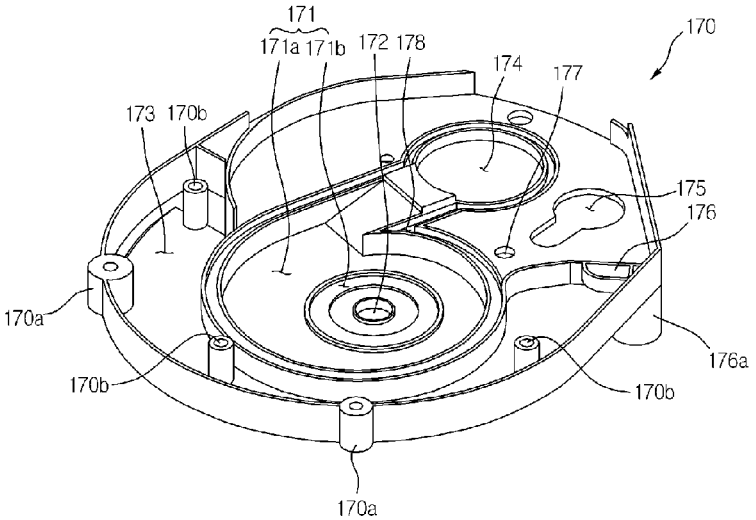
FIG. 9 is a perspective view of a pump lower depicted in FIG. 3.

FIG. 9 is a perspective view of the pump lower.

Referring to FIG. 9, the pump lower 170 is disposed on the top surface of the sump case 190.

The pump lower 170 includes one or more sump case coupling bosses 170*a* formed on an outer circumference thereof, a self-cleaning coupling boss formed on the inner portion thereof, and a washing water suction hole 172 formed on a central portion thereof.

The sump case coupling boss 170*a* is designed to simultaneously couple the self-cleaning filter assembly 120 and the sump case 190. The self-cleaning coupling boss 170*b* couples the pump lower 170 to the self-cleaning filter assembly 120. The washing water sucked by the impeller 150 flows upward through the washing water suction hole 172.

The pump case 171 is formed on a central portion of the pump lower 170. That is, the pump case 171 includes an impeller seating groove 171*b* on which the impeller 150 seats and a pumping passage 171*a* rotating the washing water sucked by the impeller 150 using centrifugal force. Here, a connecting portion extending from an end of the pumping passage 171*a* to the vario valve insertion hole 174 is inclined at a predetermined angle so that the washing water can be effectively introduced into the vario valve 210.

The pump lower 170 includes a vario valve insertion hole 174, a turbidity sensor insertion hole 175 in which the turbidity sensor 220 is inserted and which is formed near the vario valve insertion hole 174, a drain pump connecting duct 176 formed at a location spaced apart from the turbidity sensor insertion hole 175. The washing water passing through the turbidity sensor 220 is drained to the drain pump 250 through the drain pump connecting duct 176.

In addition, the pump lower 170 includes a drain hole 177 formed between the pump case 171 and the turbidity sensor insertion hole 175 and a drain pump connecting duct 176*a* extending from a bottom of a location where the drain pump connecting duct 176 is located.

The washing water drained through the drain hole 147 of the fluid passage guide 140 is introduced into the sump case 190 through the drain hole 177. The drain pump connecting duct 176*a* extends downward by a predetermined length to be connected to the inside of the drain pump 250.

The pump lower 170 further includes a pump sealer seating groove 178 formed along an outer circumference of the vario valve insertion hole 174 and the sump case 171 and a soil chamber 173 for allowing the washing water flowing backward from the drain pump 250 to flow. The pump sealer 160 is inserted in the pump sealer seating groove 178 to prevent the water from leaking out of the pump case 171. The washing water introduced into the drain pump 250 through the drain pump connecting ducts 176 and 176*a* flows backward to the soil chamber 173. The washing water directed to the soil chamber 173 is drained out of the sump assembly 100 during the drain process.

The soil chamber 173 is curved in response to the outer shape of the pump lower 170. The foreign objects contained in the washing water are collected on the floor of the soil chamber 173. The collected foreign objects are introduced into the drain pump and drained to the external side during the drain process.

Figure 10:
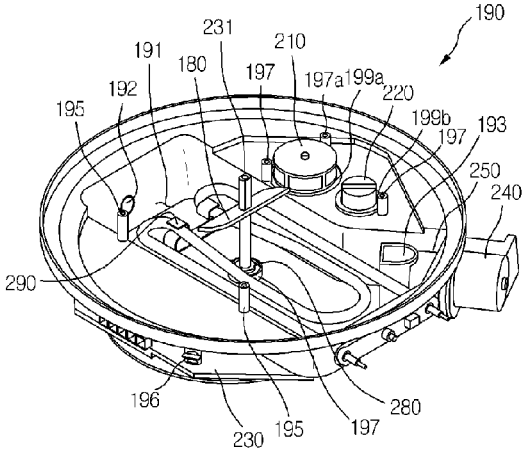
FIGS. 10 and 11 are respectively perspective and rear views of a sump case depicted in FIG. 2.
Figure 11:
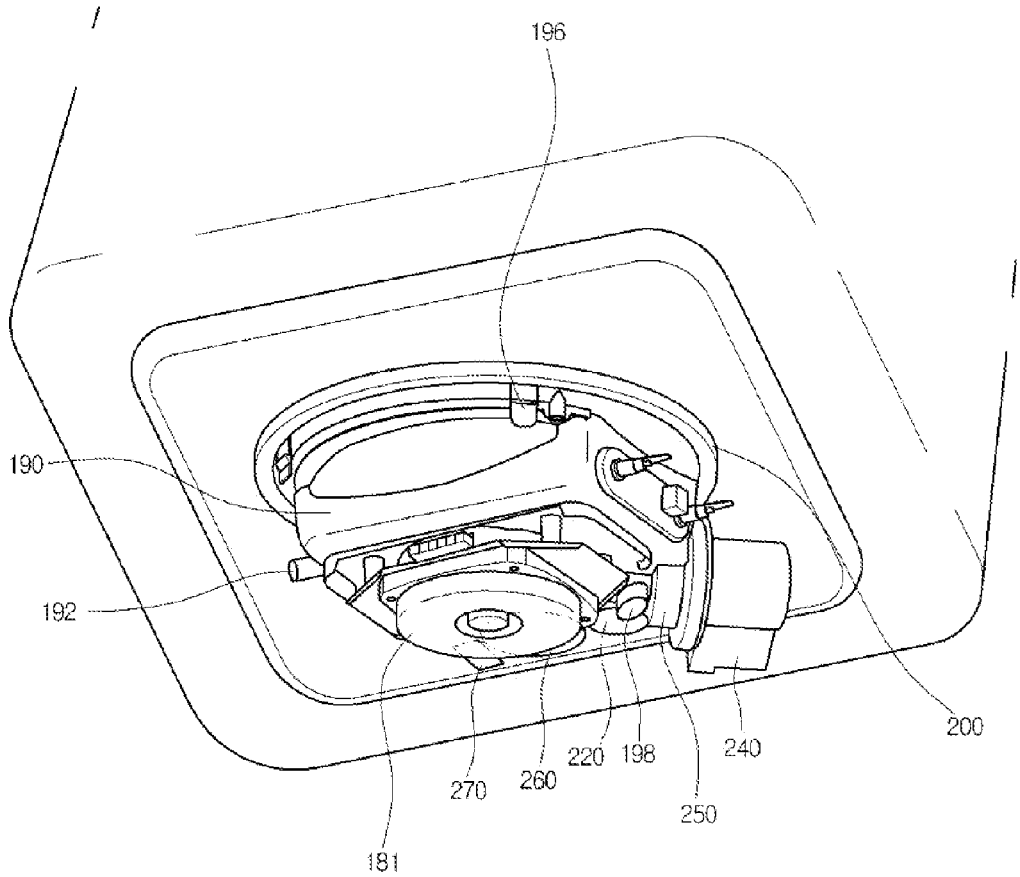

By the above-described structure, the washing water sucked by the impeller 150 rotates along the pumping passage 171*a* in the pump case 171 and flows to the vario valve 210. Here, the food residue contained in the washing water flowing into the washing pump 290 by the impeller 150 are filtered by the screen filter 179 mounted on a lower portion of the washing water suction hole 172. Then, as described above, the washing water is introduced into the drain pump 250 via the turbidity sensor 220. Then, the washing water flows backward to the soil chamber 173. The washing water directed to the soil chamber 173 flows backward to the bottom surface of the tub via the mesh filter 128 to be returned to the sump case 190 through the recovering hole 131 of the sump cover 130. The food residue accumulated in the soil chamber 173 is drained to the external side via the drain pump 250 during the drain process. FIGS. 10 and 11 are respectively perspective and rear views of the sump case. Referring to FIGS. 10 and 11, the sump case 190 includes a washing water reserving chamber 191 and a washing water inlet 192 formed on a side portion of the washing water reserving chamber 191 to allow the washing water supplied from the water supplying source to be introduced into the washing water reserving chamber 191 through thereof.

The sump case 190 further includes pump lower coupling bosses 195 formed on a top surface to be coupled to the pump lower 170, a vario valve insertion hole 199*a* formed on the top surface to receive the vario valve 210, and a turbidity sensor insertion hole 199*b* in which the turbidity sensor 220 is inserted.

The sump case 190 further includes a self-cleaning filter coupling boss 197 formed near the vario valve insertion hole 1991 and a sump cover coupling boss 197*a* formed between the frame of the sup case 190 and the vario valve insertion hole 199*a*.

That is, the self-cleaning filter coupling boss 197 couples the sump case 190 to the self-cleaning filter 120. The sump case 190 and the sump cover 130 are coupled to each other by the screw penetrating the pump lower 170 and the sump cover coupling boss 197*a*.

The sump case 190 further includes a drain pump 250 formed on a side surface thereof to drain the used washing water, a drain pump guide duct 193 in which the drain pump connecting duct 176*a* of the pump lower 170 is inserted, and a check valve (not shown) mounted in front of the drain pump guide duct 193 to prevent the washing water that is being drained from flowing backward.

The heater 200 for heating the washing water reserved in the washing water reserving chamber 191 is inserted through the side surface of the sump case 190. The heater 200 has an end securely fixed by a heater clamp 290. A drain motor 240 is coupled to a rear of the drain pump 250 to drive a drain impeller (not shown) mounted in the drain pump 250.

The motor shaft 131 of the washing motor 230 is inserted through the bottom of the sump case 190. A water sealing formed of, for example, rubber is mounted on an outer circumference of the motor shaft 231. That is, a water sealing supporting sleeve 194 in which the water sealing 280 is inserted is formed on the bottom surface of the sump case 190. By tightly inserting the water sealing 280 in the water sealing supporting sleeve 194, the washing water reserved in the washing water reserving chamber 191 is not leaked to the washing motor 230.

One or more dismountable hook 196 is formed on the frame portion of the sump case 190 so as to make it easy to dismount the sump case 190 from the floor of the tub. A portion of the outer circumference of the motor shaft 231 is cut away so that a section thereof is not non-circular-shaped. The disposer 180 is fitted around the motor shaft 231. When the disposer 180 is fitted around the motor shaft 231, the disposer 180 can rotate together with the motor shaft 231.

Meanwhile, the washing motor 230 is mounted on an outer bottom center of the sump case 190. A bypass hole 198 is formed on a location right below the drain pump guide duct 193. The bypass hole 198 is formed to allow the washing water, which cannot flow to the drain pump 250 but flows backward, to circulate toward the inside of the tub 11. A cam member (not shown) for selectively opening the lower nozzle passage 145 and the water guide passage 146, a vario motor 240 rotating the cam member, and a micro switch 270 detecting the rotation of the cam member are mounted under a location where the vario valve 210 is mounted.

By the above-described structure, the washing water introduced to the washing water inlet 192 is reserved in the washing water reserving chamber 191. The reserved washing water is heated to a predetermined temperature by the heater 200. When the washing motor 230 rotates, the disposer 180 and the impeller 150 rotate therewith. The washing water pumped by the washing pump 290 is sprayed into the tub through the spraying nozzles. The washing water contaminated during the washing process is introduced into the drain pump 250. When the drain pump 240 is operated, the washing water collected in the washing water reserving chamber 191 is drained to the external side by the drain pump 250.

The assembly process of the components of the sump assembly 100 will be described hereinafter.

First, the pump lower 170 is disposed on the top surface of the sump case 190. That is, the pump lower coupling boss 195 formed on the edge of the sump case 190 is inserted in the sump case coupling boss 170*a* formed on the frame portion of the pump lower 170. Then, the sump case coupling boss 170*a* is connected to a lower end of the self-cleaning filter coupling boss 132 formed on an inner circumference of the filter supporting sleeve 132 of the sump cover 130. Then, the self-cleaning filter coupling boss 137 is connected to a lower end of the sump case coupling hole 132*a* formed on the outer frame portion of the self-cleaning filter assembly 120. Therefore, the coupling member penetrating the sump case coupling hole 123*a* can penetrate the self-cleaning filter coupling boss 137, the sump case coupling boss 170*a*, and the pump lower coupling boss 195. That is, the self-cleaning filter assembly 120, the sump cover 130, the pump lower 170 and the sump case 190 can be coupled to each other by a single coupling member.

In addition, the self-cleaning coupling boss 197 formed inside the sump case 190 penetrates the pump lower 170 and the fluid passage guide 140 and is connected to the lower end of the self-cleaning filter coupling boss 137 protruded from the foreign object collecting layer 139 of the sump cover 130. The self-cleaning filter coupling boss 137 connected to an upper end of the self-cleaning filter coupling boss 197 is connected to a lower end of the sump cover coupling hole 123 formed on the frame bridge 125 of the self-cleaning filter assembly 120.

Therefore, the coupling member penetrating the sump cover coupling hole 123 is inserted in the self-cleaning filter coupling boss 137 of the sump cover 130 and the self-cleaning filter coupling boss 917 to couple them each other as an single body. The self-cleaning coupling boss 197 supports the pump lower 170 and the fluid passage guide 140.

In addition, the self-cleaning coupling boss 170*b* formed on the soil chamber 173 of the pump lower 170 is connected to the outer circumference of the leaked water collection sleeve 132 of the sump cover 130 and the self-cleaning filter coupling boss 137 formed on the foreign object collecting layer 138. The self-cleaning filter coupling boss 137 is connected to a lower end of the sump cover coupling hole 123 formed on the frame portion of the leaked water collecting chamber 124. Therefore, the coupling member penetrating the sump cover coupling hole 123 is inserted into the self-cleaning coupling boss of the sump cover 130 and the self-cleaning filter coupling boss 170*b* of the pump lower 170. That is, the self-cleaning filter assembly 120, the sump cover 130 and the pump lower 170 can be coupled to each other by a single coupling member.

The sump cover coupling boss 142 formed inside the washing pump cover 141 of the fluid passage guide 140 is connected to a lower end of the nozzle holder coupling boss 136 formed inside the leaked water collecting chamber 132*b* of the sump cover 130. The nozzle holder coupling boss 136 penetrates the side slot 129 for the depressed portion of the self-cleaning filter assembly 120 and is connected to the depressed portion 114 of the lower nozzle holder 110. Therefore, the coupling member penetrating the coupling hole 113 formed on the depressed portion 114 is inserted in the nozzle holder coupling boss 136 of the sump cover 130. That is, the lower nozzle holder 110, the self-cleaning filter assembly 120 and the sump cover 130 are coupled to each other by a single coupling member.

It will be apparent to those skilled in the art that various modifications and variations can be made in the present invention. Thus, it is intended that the present invention covers the modifications and variations of this invention provided they come within the scope of the appended claims and their equivalents.

INDUSTRIAL APPLICABILITY

Since the sump of the dishwasher according to the present invention can be formed in a compact size and allow the effective flow of the washing water, the industrial applicability thereof is very high.

The invention claimed is:

1. A sump of a dishwasher having a plurality of nozzles for spraying washing water, the sump comprising:

a sump case for storing the washing water;

a sump cover covering the sump case;

a self-cleaning filter installed on the sump cover to filter foreign objects contained in the washing water stored in the sump case;

a washing pump for pumping out the washing water stored in the sump case;

a pump lower receiving the washing pump and providing a soil chamber in which the foreign objects contained in the washing water are accumulated;

a washing motor installed on the sump case to drive the washing pump;

a drain pump installed on the sump case to drain the washing water; and a drain motor for driving the drain pump, wherein the sump cover comprises:

a plurality of first holes formed along a first radius on an upper surface of the sump cover to allow the washing water to flow to the sump case therethrough;

a plurality of second holes formed along a second radius on the upper surface of the sump cover to allow the washing water to flow to the sump case therethrough, the second radius being less than the first radius;

a plurality of ribs configured to be extended from an outer circumference of the sump cover downward, the ribs having an arc shape in one axis; and drain grooves formed between the downward extended portions of the ribs to allow residue to be directed to the sump case.

2. The sump according to claim 1, further comprising a fluid passage guide installed on the sump cover to guide the flow of the washing water pumped out by the washing pump.

3. The sump according to claim 1, further comprising a disposer for grinding the foreign objects by rotating by the washing motor.

4. The sump according to claim 1, further comprising a screen filter installed on the pump lower to filter foreign objects contained in the washing water flowing toward the washing pump.

5. The sump according to claim 1, further comprising a vario valve installed on the sump case to dispense the washing water pumped out from the washing pump to the plurality of nozzles.

6. The sump according to claim 5, further comprising a driving motor for driving the vario valve, a cam rotating by the driving motor, and a micro switch for detecting the rotation of the cam.

7. The sump according to claim 1, further comprising a turbidity sensor for detecting a pollution level of the washing water.

8. The sump according to claim 1, further comprising a heater installed on the sump case to heat the washing water.

9. The sump according to claim 1, further comprising a sealing member installed on a shaft of the washing motor.

10. The sump according to claim 1, further comprising a sealing member disposed along an outer circumference of the washing pump.

11. The sump according to claim 1, further comprising a lower nozzle holder installed on the sump cover to connect the nozzles to the sump cover.

12. The sump according to claim 11, where the sump cover is provided with a leaked water collecting chamber for collecting the washing water leaking at a connection with the nozzle holder and a water drain hole for returning the washing water collected in the leaked water collecting chamber into the sump case.

13. The sump according to claim 1, further comprising a nozzle holder installed on the self-cleaning filter to guide the washing water to the nozzles.

* * * * *